US007772751B2

(12) United States Patent
Suzuki et al.

(10) Patent No.: US 7,772,751 B2
(45) Date of Patent: Aug. 10, 2010

(54) SPARK PLUG HAVING A REAR-END PORTION OF A THREADED PORTION THAT HAS A HIGHER HARDNESS THAN A CRIMP PORTION AND METHOD OF MANUFACTURING THE SAME

(75) Inventors: Akira Suzuki, Aichi (JP); Takahiro Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 514 days.

(21) Appl. No.: 11/716,617

(22) Filed: Mar. 12, 2007

(65) Prior Publication Data

US 2007/0210688 A1 Sep. 13, 2007

(30) Foreign Application Priority Data

Mar. 13, 2006 (JP) ..... 2006-066911

(51) Int. Cl.
*H01T 13/00* (2006.01)

(52) U.S. Cl. ..... 313/118; 313/135

(58) Field of Classification Search ..... 313/118–145
See application file for complete search history.

(56) References Cited

U.S. PATENT DOCUMENTS

| | | | | |
|---|---|---|---|---|
| 6,446,489 | B2 * | 9/2002 | Asai et al. | 73/31.05 |
| 6,849,995 | B2 * | 2/2005 | Suzuki | 313/143 |
| 2002/0017847 | A1 * | 2/2002 | Kato et al. | 313/143 |

FOREIGN PATENT DOCUMENTS

| | | |
|---|---|---|
| JP | 2-70019 A | 3/1990 |
| JP | 2003-257583 | 9/2003 |
| JP | 2006-233269 | 9/2006 |

* cited by examiner

*Primary Examiner*—Peter J MacChiarolo
*Assistant Examiner*—Peter R Haderlein
(74) *Attorney, Agent, or Firm*—Sughrue Mion, PLLC

(57) ABSTRACT

A spark plug and method of manufacturing the same, the spark plug including a metal housing holding an insulator therein, the metal housing having a threaded portion formed on an outer circumferential surface of a frontward portion of the metal housing in a crimp portion formed at a rear end of the metal housing and crimping the insulator in the axial hole of the metal housing. Furthermore, the rear-end portion of the threaded portion has a hardness that is higher than that of the crimp portion.

12 Claims, 7 Drawing Sheets

SPARK PLUG HAVING A REAR-END PORTION OF A THREADED PORTION THAT HAS A HIGHER HARDNESS THAN A CRIMP PORTION AND METHOD OF MANUFACTURING THE SAME

BACKGROUND OF THE INVENTION

1. Field of the Invention

The present invention relates to a spark plug for mounting to an internal combustion engine for igniting an air-fuel mixture, and to a method of manufacturing the same.

The present invention can be applied to a device having a metal housing, such as a spark plug, a temperature sensor, and a gas sensor.

2. Description of the Related Art

Conventionally, an internal combustion engine uses a spark plug for ignition. An ordinary spark plug includes a center electrode whose front end portion serves as an electrode for generating spark discharge, an insulator which holds the center electrode in an axial hole thereof, and a metal housing which holds the insulator while surrounding the insulator from all radial directions. A mounting threaded portion which is formed on the outer circumferential surface of the metal housing is screwed into a mounting threaded hole in the internal combustion engine so as to mount the spark plug to the internal combustion engine. The thus-mounted spark plug generates spark discharge in the interior of a combustion chamber, thereby igniting an air-fuel mixture.

In recent years, implementation of improved output and low fuel consumption has been required of automobile engines. Under such circumstances, in order to ensure a degree of freedom in designing engines, there has been a demand for a reduction in the diameter of spark plugs. When, in order to meet the demand, the respective component sizes of a conventional spark plug are reduced in scale, the center electrode, the insulator, and the metal housing are reduced in diameter accordingly. However, reducing the diameter of the center electrode may lead to a reduction in thermal conductivity along the axial direction and deterioration in consumption resistance and thermal resistance. Thus, a reduction in the diameter of a spark plug is desirably implemented in conjunction with improvements in material strength and reduction in thickness of the metal housing.

Meanwhile, the metal housing has a seal portion which projects in the manner of a flange and is located rearward of the mounting threaded portion thereof. When the spark plug is mounted to an engine head of the internal combustion engine, a gasket intervenes between the seal portion and a peripheral portion around an opening of the mounting threaded hole in the engine head to maintain gastightness in the interior of the engine, the mounting threaded portion being screwed into the mounting threaded hole. A portion of the metal housing between the seal portion and the mounting threaded portion is a so-called screw neck and has a diameter smaller than the pitch diameter of the mounting threaded portion and the outside diameter of the seal portion. Furthermore, when a gasket is employed to airtightly seal a combustion chamber, in order to prevent detachment of the gasket, the screw neck has an engaging portion which is provided in the form of a groove along a circumferential direction of the metal housing and with which the gasket is engaged.

When the spark plug is fastened to the engine head, tensile stress is imparted to the screw neck. Particularly, tensile stress is apt to concentrate in a portion of the mounting threaded portion which is proximate to a threading start position at a rear end of thread formed on the mounting threaded portion.

This portion is called a "thread rear-end portion." More specifically, the thread rear-end portion ranges at least one pitch of thread as measured in axially opposite directions with the rear threading start position as the center of measurement. In the case where the thickness of the metal housing is reduced as mentioned above, if the spark plug is fastened to the engine head with a fastening torque greater than a predetermined value, cracking or rupture may occur in the thread rear-end portion.

A conceivable measure to cope with the above problem is to manufacture the metal housing from a steel material having a high carbon content so as to enhance its mechanical strength. However, this results in a loss of toughness. Therefore, when crimping is performed in the process of assembling the insulator with the metal housing, cracking may occur in a crimp portion of the metal housing. In order to cope with this problem, in the process of manufacturing the metal housing, a steel material is subjected to heating, finish rolling, and then cooling under predetermined conditions so as to impart, to the metal housing, a composite microstructure consisting of a ferrite phase accounting for a volume content of 60% or more and a phase formed through low-temperature transformation, which is martensite or bainite, or a mixed microstructure thereof. This can enhance both mechanical strength and toughness of the metal housing, so that the occurrence of cracking or rupture can be prevented particularly in the thread rear-end portion (refer to, for example, Patent Document 1).

[Patent Document 1] Japanese Patent Application Laid-Open (kokai) No. 2-70019.

PROBLEMS TO BE SOLVED BY THE INVENTION

However, according to Patent Document 1, the entire metal housing is enhanced in hardness in the process of manufacturing the same. Thus, when the insulator is fixed in the metal housing through crimping in the course of assembly of the spark plug, the crimp portion of the metal housing may suffer insufficient deformation or nonuniform deformation. Insufficient crimping may cause difficulty in maintaining gastightness between the metal housing and the insulator through crimping.

SUMMARY OF THE INVENTION

The present invention has been achieved for solving the above problems, and an object thereof is to provide a spark plug having a crimp portion which exhibits easy deformation during crimping, and a thread rear-end portion that resists cracking or rupturing when fastened to a cylinder head, as well as a method of manufacturing the same.

The above object of the present invention has been achieved by providing a spark plug comprising: a center electrode; an insulator having an axially extending axial hole and holding the center electrode in a front end portion of the axial hole, and a metal housing holding the insulator therein, wherein the metal housing comprises: a threaded portion formed on an outer circumferential surface of a frontward portion of the metal housing; and a crimp portion formed at a rear end of the metal housing and crimping the insulator in the axial hole of the metal housing, wherein a rear-end portion of the threaded portion (thread rear-end portion) has a hardness that is higher than that of the crimp portion.

In the spark plug of the invention, the thread rear-end portion has a hardness that is higher than that of the crimp portion. Thus, in contrast to the thread rear-end portion, which must be mechanically strong, the crimp portion can have a relatively low deformation resistance. Therefore, the crimp portion can readily be deformed when the insulator is fixed in the metal housing through crimping. Meanwhile, when the spark plug is mounted to the internal combustion engine, the mounting threaded portion of the metal housing is screwed into the mounting threaded hole in the internal combustion engine. At this time, tensile stress associated with the threading engagement is apt to concentrate in the threading start position at the rear end of the thread formed on the mounting threaded portion. Meanwhile, as the hardness of the crimp portion increases, the toughness thereof decreases. Thus, if the crimp portion is excessively hard, the crimp portion may rupture or crack when the insulator is fixed in the interior of the metal housing through crimping. In view of the above, as in the case of the present invention, by rendering the thread rear-end portion to have a higher hardness than the crimp portion, even when the spark plug is fastened to the engine head with a fastening torque greater than a predetermined value, cracking or a rupture is unlikely to occur in the thread rear-end portion. In this manner, by increasing the hardness at the thread rear-end portion while maintaining easy deformation at the crimp portion, a thin-walled metal housing can be manufactured. Accordingly, the diameter of the spark plug can be reduced without the need to excessively reduce the outside diameter of the insulator to be held in the metal housing. An example spark plug that can effectively utilize this structural feature is one in which the difference between the inside diameter of the metal housing as measured at an axial position where the thread rear-end portion is located and the outside diameter of an intermediate trunk portion of the insulator measured at the axial position is 0.1 mm to 0.5 mm.

Preferably, the above-mentioned metal housing is formed such that the difference in hardness between that of the rear end portion of the threaded portion (the thread rear-end portion) and the crimp portion is a Vickers hardness of 100 HV or more. In order to lower deformation resistance associated with crimping, the crimp portion is preferably formed such that the hardness thereof does not become relatively high. In contrast, as mentioned above, in the thread rear-end portion, tensile stress is apt to concentrate in the threading start position at the rear end of thread. In view of the above, by rendering the hardness of the thread rear-end portion a Vickers hardness of 50 HV or more higher than the hardness of the crimp portion, the thread rear-end portion can have sufficiently high mechanical strength. As a result, even when the above-mentioned tensile stress concentrates therein, the thread rear-end portion can be free from cracking or rupture. Preferably, the thread rear-end portion has a Vickers hardness of from 250 HV to 400 HV, and the crimp portion has a Vickers hardness of from 160 HV to 260 HV.

Furthermore, by rendering the carbon content of the thread rear-end portion higher than that of the crimp portion, the hardness of the thread rear-end portion can be reliably increased. In other words, locally increasing the carbon content of the thread rear-end portion means that there is no need to increase the carbon content of the entire metal housing. Thus, the hardness of the crimp portion is not increased, so that the crimp portion can easily deform. Specifically, by subjecting the thread rear-end portion to a carburizing process, the carbon content of the thread rear-end portion can be higher than that of remaining portions including the crimp portion. Since the above-mentioned partial hardening generally progresses gradually from the exterior surface, preferably, formation of the engaging portion with which a gasket is engaged and cutting or grinding are completed in advance of the partial hardening.

Preferably, the thread rear-end portion of the metal housing includes carbon in a range of from 0.3 to 0.8 percent by weight, while the crimp portion includes carbon in a range from 0.06 to 0.2 percent by weight.

Furthermore, the crystal structure in the thread rear-end portion preferably includes martensite so that the strength of the thread rear-end portion can be greatly enhanced. As the result, cracking or rupture can be prevented effectively during tightening and fixing a spark plug to an engine head. However, if the whole of a metal housing is reinforced by martensite, machinability of the metal housing is deteriorated. Therefore, martensite preferably is selectively deposited in the thread rear-end portion. When a half cross-section of the thread rear-end portion is observed, 10% or more of the observed surface preferably constitutes a martensite phase.

On the other hand, preferably, the crimp portion of the metal housing substantially does not include a martensite phase so that machinability of the crimp portion is secured and cracking or gas leakage can be prevented. Instead of martensite, the crimp portion preferably includes at least one of an austenite phase and a pearlite phase.

In the method of manufacturing a spark plug of the invention, a cylindrical member which serves as a prototype of the metal housing is formed by cold forging, and, after a thread-cutting step of forming a thread, e.g. by rolling, a partial hardening step is carried out for increasing the hardness of the thread rear-end portion. This prevents a reduction in machinability of the thread rear-end portion before the thread is formed through rolling. After the thread-cutting step, the thread rear-end portion is subjected to a carburizing process or a quenching process, whereby the hardness of the thread rear-end portion can be increased relative to that of other portions including the crimp portion.

The engaging portion has a structure for engaging the gasket. By imparting, to the engaging portion, the form of a groove along a circumferential direction of the metal housing, machining for forming the engaging portion can be facilitated. By forming the engaging portion before the partial hardening step of increasing the hardness of the thread rear-end portion, the engaging portion can be readily machined into the form of a groove.

DESCRIPTION OF REFERENCE NUMERALS

Figure 1:
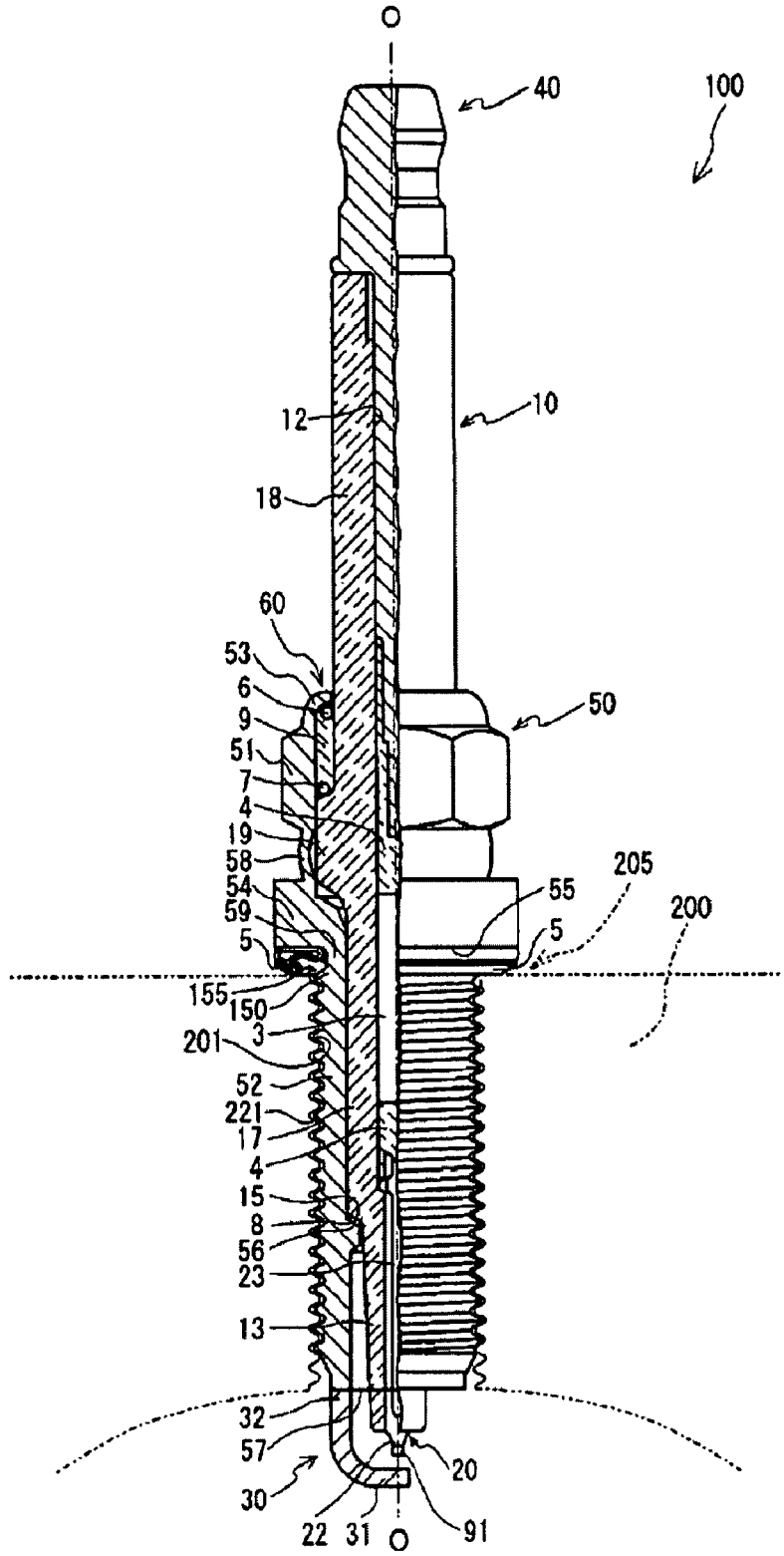
FIG. 1 is a partial sectional view of a spark plug 100.

Reference numerals used to identify structural features shown in the drawings include the following:

| | |
|---|---|
| 5: | gasket |
| 10: | insulator |
| 12: | axial hole |
| 20: | center electrode |
| 50: | metal housing |
| 52, 521: | mounting threaded portion |
| 53, 553: | crimp portion |
| 54: | seal portion |
| 56, 561: | stepped portion |
| 59: | engaging portion |
| 100: | spark plug |
| 150: | thread rear-end portion |
| 155: | threading start position |
| 201: | mounting threaded hole |
| 205: | peripheral-portion-around-opening |
| 220: | machined workpiece |

DETAILED DESCRIPTION OF THE PREFERRED EMBODIMENTS

A spark plug and a method of manufacturing the same according to an embodiment of the present invention will next be described in detail with reference to the drawings. However, the present invention should not be construed as being limited thereto.

First, referring to FIG. 1, the structure of an embodiment of a spark plug 100 is described. FIG. 1 is a partial sectional view of the spark plug 100. In FIG. 1, the direction of an axis O of the spark plug 100 is referred to as the vertical direction. In the following description, the lower side of the spark plug 100 in FIG. 1 is referred to as the front end side of the spark plug 100, and the upper side as the rear end side.

As shown in FIG. 1, the spark plug 100 includes an insulator 10; a metal housing 50 which holds the insulator 10; a center electrode 20 which is held in the insulator 10 in the direction of the axis O; a ground electrode 30 having a proximal end portion 32 welded to a front end face 57 of the metal housing 50 and a distal end portion 31 including one side surface facing a front end portion 22 of the center electrode 20; and a metallic terminal member 40 provided at a rear end portion of the insulator 10.

First, the insulator 10 of the spark plug 100 will be described. As well known, the insulator 10 is formed by firing from alumina or the like and has a tubular shape having an axial hole 12 extending in the direction of the axis O at the center thereof. A flange portion 19 of maximum outside diameter is formed generally at the center in the direction of the axis O, and a rear trunk portion 18 is formed rearward (upward in FIG. 1) of the flange portion 19. A front trunk portion 17 is formed frontward (downward in FIG. 1) of the flange portion 19 and is smaller in outside diameter than the rear trunk portion 18. A leg portion 13 is formed frontward of the front trunk portion 17 and is smaller in outside diameter than the front trunk portion 17. The outside diameter of the leg portion 13 is reduced toward the front end side. When the spark plug 100 is mounted to an engine head 200 of an internal combustion engine, the leg portion 13 is exposed to a combustion chamber of the internal combustion engine. A stepped portion 15 is formed between the leg portion 13 and the front trunk portion 17.

The center electrode 20 is formed from a nickel alloy, such as INCONEL 600 or 601 (trade name), or the like and has therein a metallic core 23 formed from copper or the like and having excellent thermal conductivity. The front end portion 22 of the center electrode 20 projects from the front end face of the insulator 10 and is formed such that the diameter thereof reduces toward the front end side. In order to improve resistance to spark-induced consumption, a chip 91 formed from a noble metal is joined to the front end face of the front end portion 22. The center electrode 20 is electrically connected to the metallic terminal member 40 located above via a sealing material 4 and a ceramic resistor 3, which are provided in the axial hole 12. A high-voltage cable (not shown) is connected to the metallic terminal member 40 via a plug cap (not shown) for applying high voltage thereto.

Next, the ground electrode 30 will be described. The ground electrode 30 is formed from a metal having high corrosion resistance; for example, a nickel alloy, such as INCONEL 600 or 601 (trade name). The ground electrode 30 has a generally rectangular cross section perpendicular to the longitudinal direction thereof. The proximal end portion 32 of the ground electrode 30 is welded to the front end face 57 of the metal housing 50. The distal end portion 31 of the ground electrode 30 is bent such that one side surface thereof faces the front end portion 22 of the center electrode 20.

Next, the metal housing 50 will be described. The metal housing 50 is a cylindrical, metallic member for fixing the spark plug 100 to the engine head 200 of the internal combustion engine. The metal housing 50 holds the insulator 10 therein while surrounding a portion of the insulator 10 which extends from a portion of the rear trunk portion 18 to the leg portion 13. The metal housing 50 is formed from low-carbon steel and includes a tool engagement portion 51 with which an unillustrated spark plug wrench is engaged, and a mounting threaded portion 52 on which an external thread 221 is formed and which is screwed into a mounting threaded hole 201 in the engine head 200 provided at an upper portion of the internal combustion engine.

In the metal housing 50, a flange-like seal portion 54 is formed between the tool engagement portion 51 and the mounting threaded portion 52. A portion between the rear end of the mounting threaded portion 52; i.e., a threading start position 155 at the rear end of the thread 221 formed on the mounting threaded portion 52, and a seat surface 55 of the seal portion 54 is called a screw neck. The screw neck is smaller in outside diameter than the seal portion 54 and the mounting threaded portion 52. When the spark plug 100 is mounted to the engine head 200, a gasket 5 intervenes between the seat surface 55 of the seal portion 54 and a peripheral-portion-around-opening 205 around the mounting threaded hole 201 in the engine head 200, the mounting threaded portion 52 being screwed into the mounting threaded hole 201. The gasket 5 is fitted to the screw neck. Fastening for mounting causes the gasket to be deformed between the peripheral-portion-around-opening 205 of the engine head 200 and the seat surface 55 of the seal portion 54, and the deformed gasket 5 provides a seal therebetween, thereby preventing leakage of gas from inside the engine via the mounting threaded hole 201. The screw neck has a groove-like engaging portion 59 with which the gasket 5 is engaged. The engaging portion 59 is provided along the entire circumference of the metal housing 50. The gasket 5 has an inside diameter slightly greater than the outside diameter of the mounting threaded portion 52. The gasket 5 is fitted to the screw neck from the front end side of the metal housing 50 and is brought into contact with the seat surface 55 of the seal portion 54. At this time, a hole portion of the gasket 5 is crushed to engage the engaging portion 59, thereby preventing detachment of the gasket 5 from the screw neck.

The metal housing 50 has a thin-walled crimp portion 53 provided rearward of the tool engagement portion 51 as well as a thin-walled buckle portion 58 provided between the seal portion 54 and the tool engagement portion 51. Annular ring members 6 and 7 intervene between an inner circumferential surface of the metal housing 50 ranging from the tool engagement portion 51 to the crimp portion 53 and an outer circumferential surface of the rear trunk portion 18 of the insulator 10. A powder of talc 9 fills a space between the ring members 6 and 7. Crimping an end portion 60 of the crimp portion 53 in an inwardly bending manner causes the insulator 10 to be pressed frontward within the metal housing 50 via the ring members 6 and 7 and the talc 9. As a result, a stepped portion 15 of the insulator 10 is supported, via an annular sheet packing 8, on a stepped portion 56 formed on an inner circumferential surface of the metal housing 50 which corresponds to the mounting threaded portion 52. The metal housing 50 and the insulator 10 are thus-united together. The sheet packing 8 maintains gastightness between the metal housing 50 and the insulator 10, thereby preventing outflow of combustion gas. The buckle portion 58 is designed to be outwardly deformed in association with application of compressive force during crimping, thereby contributing toward increasing the stroke of compression of the talc 9 and thus enhancing gastightness.

Figure 2:
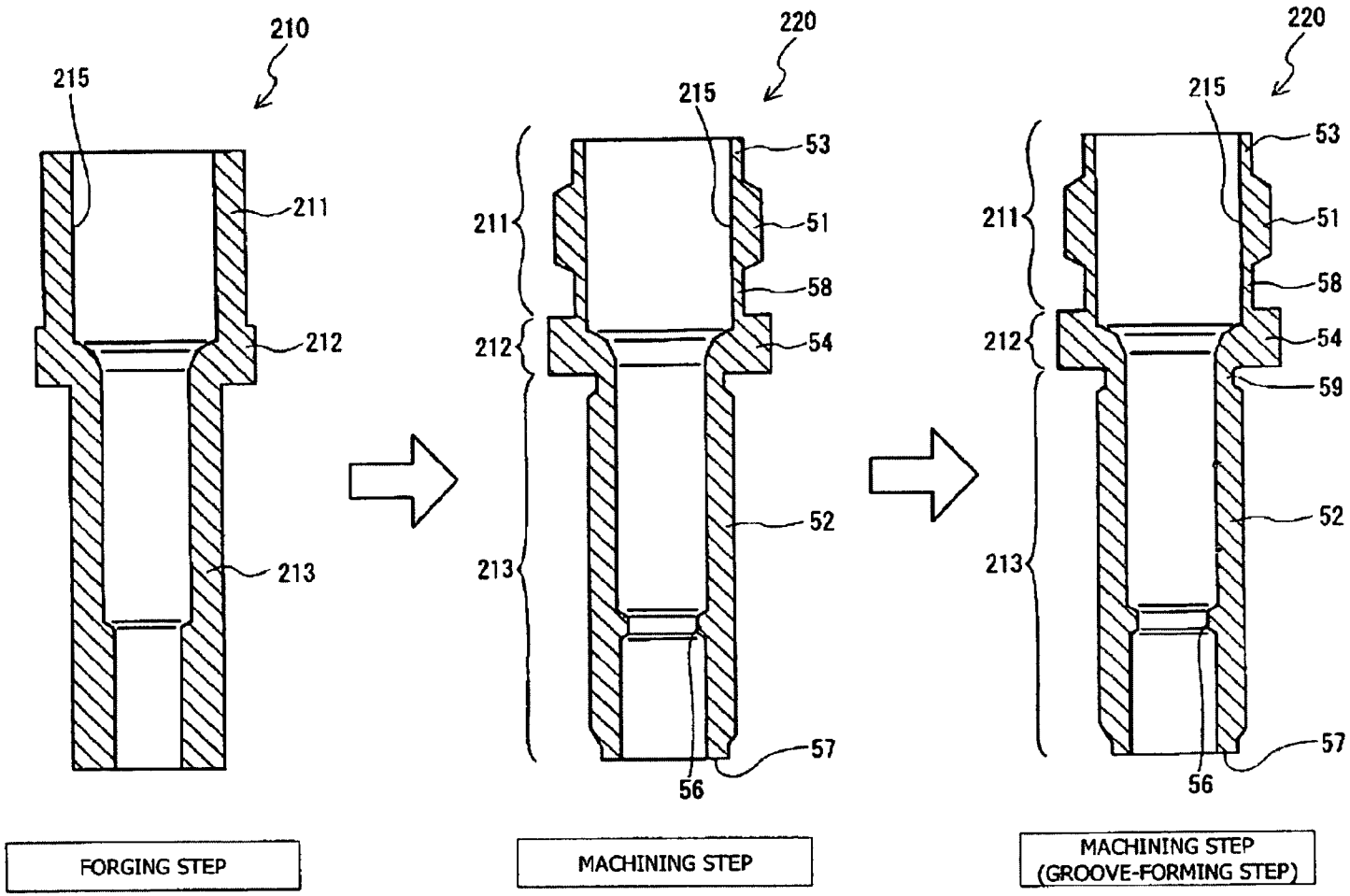
FIG. 2 is a view showing steps of a process for manufacturing a metal housing 50.
Figure 3:
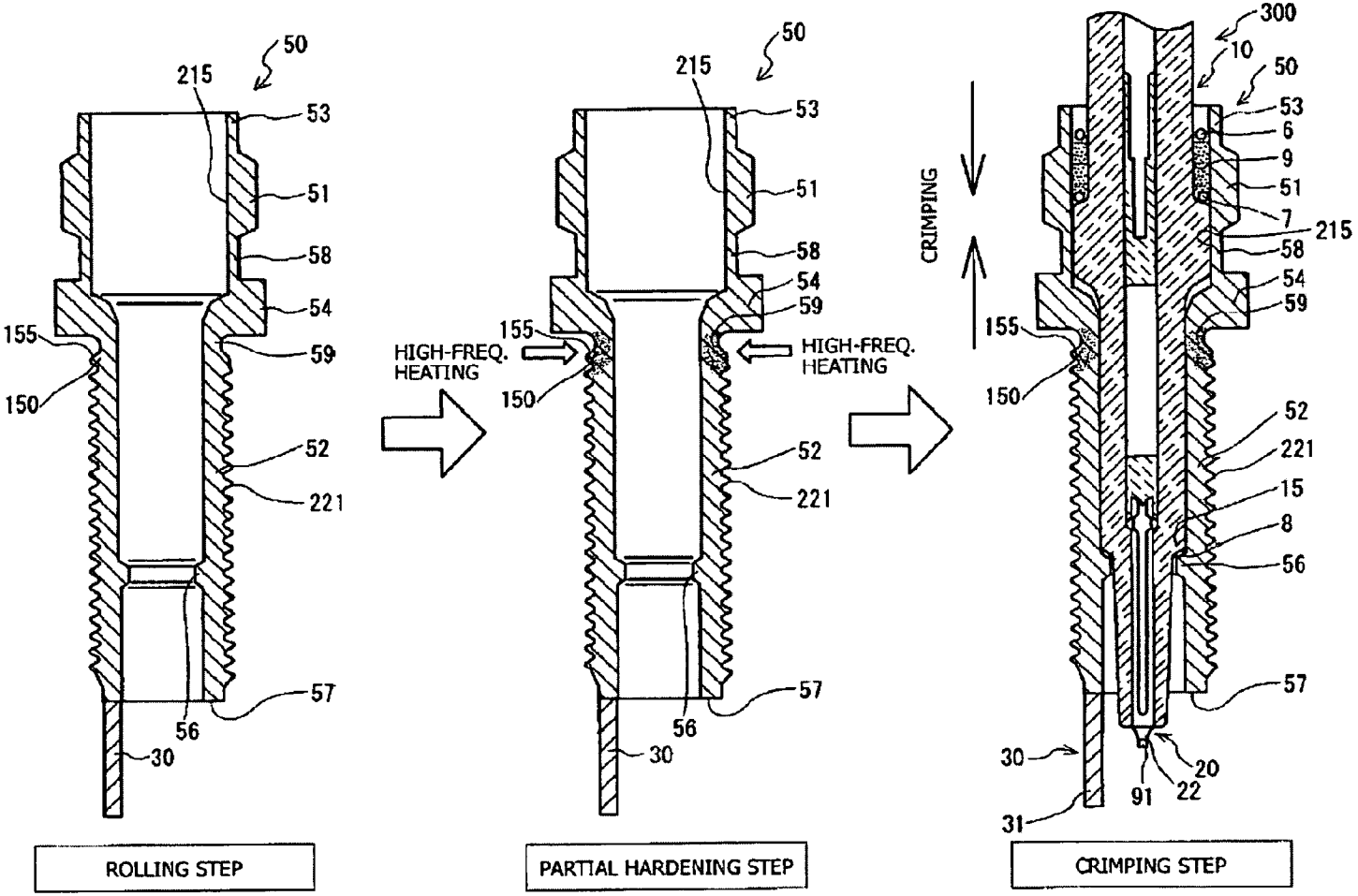
FIG. 3 is a view showing steps of a process for manufacturing the metal housing 50 and assembling an insulator 10 to the metal housing 50.

When the spark plug 100 having the above-described structure is fastened to the engine head 200, tensile stress is exerted to the screw neck and a portion of the mounting threaded portion 52 which is proximate to the threading start position 155 at the rear end of the thread 221 of the mounting threaded portion 52. In the present embodiment, this portion is called a "thread rear-end portion 150." More specifically, the thread rear-end portion 150 is a portion of the mounting threaded portion 52 which is contained in a range corresponding to at least one pitch of the thread 221 and equally extends from the threading start position 155 of the thread 221 in opposite directions along the axis O. Since the engaging portion 59 is provided at the screw neck provided between the threading start position 155 of the thread 221 and the seat surface 55 of the seal portion 54, the engaging portion 59 is included partially or entirely in the thread rear-end portion 150. In order to impart consistent strength to the screw neck and the thread rear-end portion 150 by enhancing hardness and toughness, the present embodiment includes a carburizing process, a quenching process, and a tempering process carried out on the thread rear-end portion 150 in the process of manufacturing the metal housing 50. Hereinafter, a process of manufacturing the spark plug 100 will be described with reference to FIGS. 2 and 3. FIG. 2 is a view showing steps of a process for manufacturing the metal housing 50. FIG. 3 is a view showing steps of a process for manufacturing the metal housing 50 and assembling the insulator 10 to the metal housing 50.

The metal housing 50 is manufactured as follows. First, as shown in FIG. 2, a pipe-like steel material of low-carbon steel (low-carbon steel of 6C to 35C, such as S10C or S15C) is set on an unillustrated cold forging machine, and a forged workpiece 210 which will become the metal housing 50 is formed through forging, such as extrusion forming (forging step). The forged workpiece 210 assumes a tubular shape having a through-hole 215 into which the insulator 10 is inserted. The forged workpiece 210 has, on its circumference, a rear tubular portion 211, which will become the crimp portion 53, the tool engagement portion 51, and the buckle portion 58; an intermediate tubular portion 212, which will become the seal portion 54; and a front tubular portion 213, which will become the engaging portion 59 and the mounting threaded portion 52. The rear, intermediate, and front tubular portions 211, 212, and 213 are formed in a stepped manner. The intermediate tubular portion 212 and the front tubular portion 213 are formed cylindrically. The rear tubular portion 211 is formed hexagonally so as to be compatible with the external shape (see FIG. 1) of the completed tool engagement portion 51. The external shape of the tool engagement portion 51 is not limited to a hexagonal shape, but may assume another shape, such as BI-HEX shape. Also, the low-carbon steel material does not necessarily assume the form of a pipe, but may assume the form of a solid rod.

Next, the forged workpiece 210 is set on an unillustrated machining apparatus and undergoes machining such that the wall surface of the through-hole 215 and the outer circumferential surface thereof assume structural profiles of the metal housing 50, thereby yielding a machined workpiece 220 (machining step). Specifically, a portion of the wall surface of the through-hole 215 which is located frontward of the stepped portion 56 is machined so as to establish a clearance (see FIG. 1) between the same and the leg portion 13 of the insulator 10 when the insulator 10 is held in the metal housing 50. Relevant portions of the rear tubular portion 211 are machined into the crimp portion 53 and the buckle portion 58 which are annular, and the remaining portion of the rear tubular portion 211 is machined into the tool engagement portion 51. The intermediate tubular portion 212 is machined into the seal portion 54. The front tubular portion 213 is machined into an externally raised threadless portion which will become the mounting threaded portion 52. In the process of machining the front tubular portion 213, the groove-like engaging portion 59 is formed at the screw neck, which is a portion between the seal portion 54 and the mounting threaded portion 52, along the entire circumference thereof (the groove-forming step in the machining step).

As shown in FIG. 3, the ground electrode 30 is welded to the front end face 57 of the machined workpiece 220 through, for example, resistance welding. In this condition, by use of an unillustrated rolling die, the thread 221 is formed, by rolling, on the externally raised threadless portion which will become the mounting threaded portion 52, whereby the shape of the metal housing 50 is formed (rolling step). The machined workpiece 220 corresponds to a "cylindrical member serving as a prototype of the metal housing" in the present invention.

Next, the thread rear-end portion 150 of the metal housing 50 is subjected to a carburizing, quenching and tempering so as to partially harden the metal housing 50 (partial hardening step).

First, a carburizing process for increasing the carbon content of the thread rear-end portion 150 of the metal housing 50 is performed. This process is performed, for example, as follows: after protecting a portion of the metal housing 50 other than the thread rear-end portion 150 with an anti-carburizing agent, the metal housing 50 is heated in a carbon atmosphere. Alternatively, carburization may be performed as follows: before the carburizing process, the thread rear-end portion 150 is masked, and then the metal housing 50 is subjected to copper plating; subsequently, the entire metal housing 50 is subjected to the carburizing process.

After the carburizing process is performed, the carbon content of the thread rear-end portion 150 is preferably 0.3% by weight to 0.8% by weight as measured as follows: three samples, each having a size of 1 mm square and about 1 g, are cut out from the thread rear-end portion 150; the samples are measured for carbon content by use of a known carbon-sulfur analyzer (CS); and carbon content measurements are averaged. As mentioned previously, a low-carbon steel material is used to form the metal housing 50, and the carbon content thereof is generally 0.06% by weight to 0.2% by weight. If the carbon content after carburization is less than 0.3% by weight, a quenching process, which will be described later, may fail to impart sufficient hardness to the thread rear-end portion 150. The higher the carbon content, the higher the hardness. However, a carbon content of 0.8% by weight or less suffices. An attempt to increase the carbon content to over 0.8% by weight is undesirable since it requires a longer carburization time and a higher carbon concentration for carburization.

Next, the quenching process is locally carried out on the thread rear-end portion 150 whose carbon content has been increased by the above-mentioned carburizing process, whereby the strength thereof is enhanced through formation of martensite. This quenching process uses, for example, a known high-frequency heating apparatus (not shown). The high-frequency heating apparatus is used as follows: a coil is arranged so as to surround the thread rear-end portion 150, and AC current is applied to the coil for locally heating the thread rear-end portion 150 by means of eddy currents generated therein through electromagnetic induction. The heating temperature for the thread rear-end portion 150 is determined by the following expression.

Martensitic transformation temperature (Ms point) (° C.)=550−350×C %−40×Mn %−35×V %−20×Cr %−17×Ni %−10×Cu %−10×Mo %−5×W %+15×Co %+30×Al % wherein C %, Mn %, V %, Cr %, Ni %, Cu %, Mo %, W %, Co %, and Al % are the respective contents of elements in the steel material. This indicates that an increase in carbon content of the thread rear-end portion 150 to be subjected to the quenching process has a great effect on martensitic transformation temperature.

In order to alleviate residual stress and to obtain consistent mechanical strength through enhancement of toughness for the thread rear-end portion 150 which has undergone the quenching process, a tempering process is carried out. This tempering process also uses a high-frequency heating apparatus (not shown) similar to that mentioned above.

Having undergone the above-mentioned partial hardening step, the thread rear-end portion 150 of the metal housing 50 can have a hardness higher than that of other portions thereof. In other words, since the crimp portion 53 and the buckle portion 58 are not hardened, high machinability thereof as observed when the crimp portion 53 and the buckle portion 58 are formed through machining is maintained intact. Desirably, the difference between the hardness of the thread rear-end portion 150 and the hardness of the crimp portion 53 is a Vickers hardness of 50 HV or more. The hardness of the thread rear-end portion of each of the following samples which was examined in the following test is adjusted by conducting the above partial hardening process (a carburizing process, a quenching and tempering process).

For example, in manufacture of the metal housing 50 of the present embodiment, the distance between the wall surface of the through-hole 215 and an imaginary cylinder whose diameter is defined as a pitch diameter of the thread 221 of the mounting threaded portion 52; i.e., the average thickness of the mounting threaded portion 52 is made 1.8 mm, and the thickness of the screw neck as measured before formation of the engaging portion 59 is made 1.4 mm. The engaging portion 59 is formed such that the thickness thereof becomes 1.25 mm. The crimp portion 53 and the buckle portion 58 are formed such that the thickness thereof becomes 0.75 mm. When these dimensions are employed and the metal housing 50 is formed from a low-carbon steel material having a Vickers hardness of about 200 HV, the crimp portion 53 and the buckle portion 58 can exhibit sufficient ease of deformation during crimping. Meanwhile, by enhancing the hardness of the thread rear-end portion 150 by the partial hardening step such that the hardness of the thread rear-end portion 150 is a Vickers hardness of 50 HV or more higher than the hardness of the crimp portion 53, occurrence of cracking or rupture in the thread rear-end portion 150 whose dimensions are determined under the above-mentioned dimensional conditions can be sufficiently prevented when the completed spark plug 100 is mounted to the engine head 200 (see FIG. 1).

Figure 4:
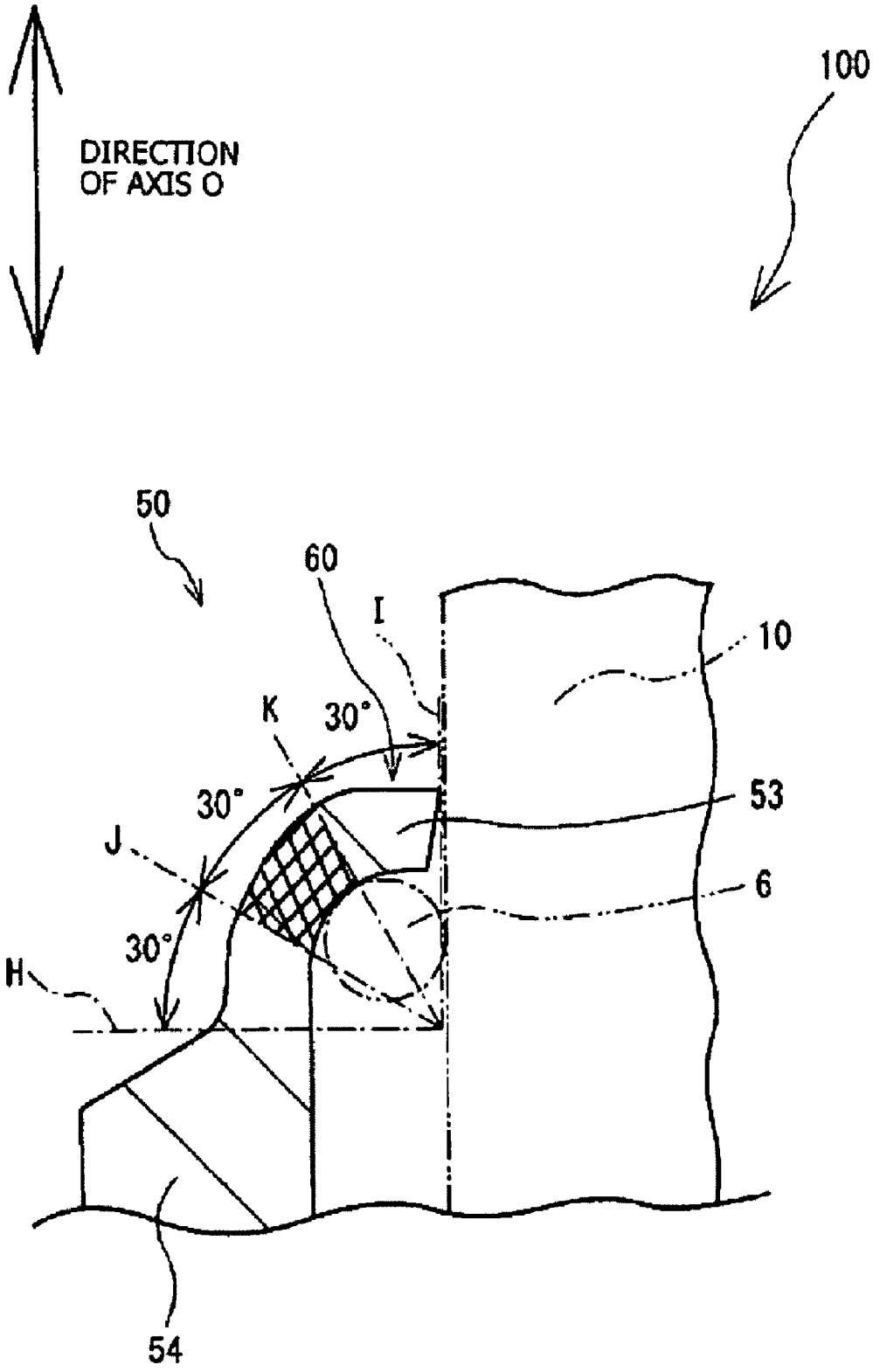
FIG. 4 is a view illustrating a position for measuring the hardness of a crimp portion 53.

For comparison between the hardness of the thread rear-end portion 150 and the hardness of the crimp portion 53, the hardness of the following specific region may be measured. First, the hardness of the crimp portion 53 may be measured in the hatched region shown in FIG. 4. Specifically, in a certain section of the spark plug 100 which passes through the axis O, while the intersection of a horizontal imaginary line H (an imaginary line orthogonal to the direction of the axis O) passing through the boundary between the crimp portion 53 and the tool engagement portion 51 (inflection point along their contours) and a vertical imaginary line I (an imaginary line along the direction of the axis O) passing through a point located most rearward along the direction of the axis O on the end portion 60 of the crimp portion 53 having undergone crimping is taken as the origin, a region of the section of the crimp portion 53 which is sandwiched between the imaginary lines H and I is trisected into 30° subregions with imaginary lines J and K. Hardness is measured at five arbitrary points in the subregion of the section of the crimp portion 53 which is sandwiched between the imaginary lines J and K (hatched region in FIG. 4). The average of the five measured hardness values may be taken as the hardness of the crimp portion 53. Hardness of the thread rear-end portion of the following samples was measured in the same manner.

Figure 5:
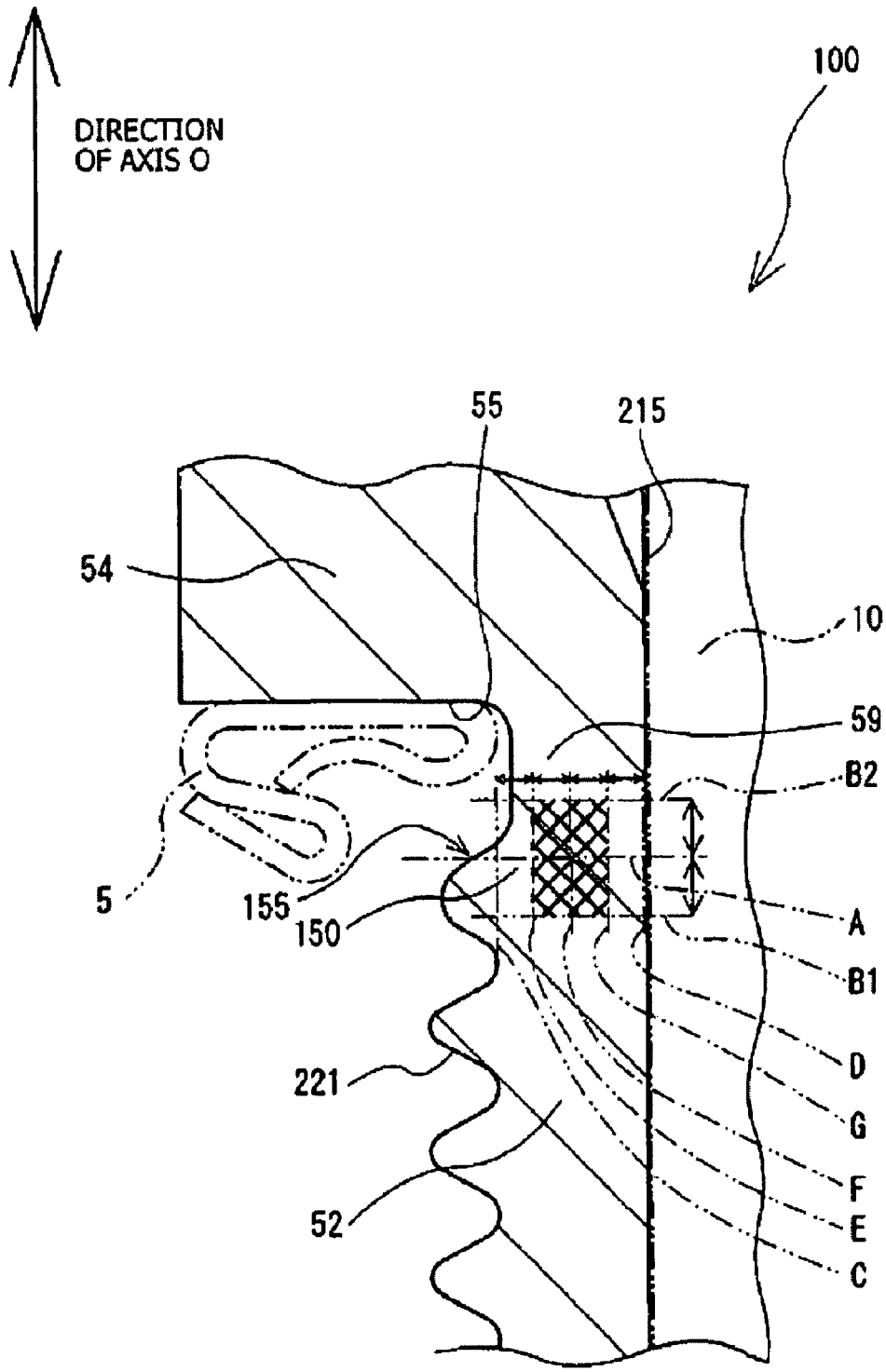
FIG. 5 is a view illustrating a position for measuring the hardness of a thread rear-end portion 150.

The hardness of the thread rear-end portion 150 may be measured in the hatched region shown in FIG. 5. Specifically, in a certain section of the spark plug 100 which passes through the axis O, while an imaginary horizontal line A (an imaginary line orthogonal to the direction of the axis O) passing through the threading start position 155 of the thread 221 serves as a centerline, there are assumed imaginary lines B1 and B2 which are parallel to the imaginary line A and are respectively 0.5 mm away from the imaginary line A in opposite directions along the axis O. While there is assumed a vertical imaginary line C (an imaginary line along the direction of the axis O) which passes through a root between the first thread and the second thread as counted from the rear end of the thread 221 of the mounting threaded portion 52, a region of the section of the thread rear-end portion 150 which is sandwiched between the imaginary line C and a vertical imaginary line D which extends along the through-hole 215 of the metal housing 50 is quadrisected with vertical imaginary lines E, F and G. Hardness is measured at five arbitrary points in a subregion of the section of the thread rear-end portion 150 which is surrounded by the imaginary lines B1, B2, E, F and G (hatched region in FIG. 5). The average of the five measured hardness values may be taken as the hardness of the thread rear-end portion 150.

The buckle portion 58 has a thickness equal to that of the crimp portion 53, and the buckle portion 58 is not subjected to hardening. Thus, the buckle portion 58 can be considered to have a hardness equivalent to that of the crimp portion 53. If a comparison between the thus-obtained hardness of the thread rear-end portion 150 and the thus-obtained hardness of the crimp portion 53 and the buckle portion 58 indicates that, as mentioned previously, the hardness of the thread rear-end portion 150 is a Vickers hardness of 50 HV or more higher than the hardness of the crimp portion 53 and the buckle portion 58, then this is a desirable condition.

As shown in FIG. 3, in the metal housing 50 whose thread rear-end portion 150 has been hardened, the sheet packing 8 is inserted into the through-hole 215 and is caused to rest on the stepped portion 56. An electrode intermediate 300 is inserted into the metal housing 50. The electrode intermediate 300 is manufactured in a process separate from that described above by assembling the center electrode 20 and the metallic terminal member 40 with the insulator 10. The stepped portion 15 of the electrode intermediate 300 is supported on the sheet packing 8. Furthermore, the ring member 7, the powder of talc 9, and the ring member 6 are sequentially inserted into the metal housing 50. By use of an unillustrated crimping die, the crimp portion 53 undergoes crimping. During the crimping work, the buckle portion 58 is deformed outwardly, thereby enhancing gastightness which is established through crimping (crimping step). Furthermore, the distal end portion 31 of the ground electrode 30 is bent so as to face the front end portion 22 of the center electrode 20. The spark plug 100 shown in FIG. 1 is thus completed.

Example 1

An evaluation test was conducted to confirm an effect achieved by the metal housing 50 in which the thread rear-end portion 150 has a higher hardness than the crimp potion 53. In this evaluation test, six types of metal housing were produced by means of a different partial hardening step so that their thread rear-end portions exhibit different hardness from one another. Using the metal housings, six sample spark plugs (Samples 1 to 6) were produced. In order to highlight the difference in performance, metal housings whose nominal outside diameter of the threaded portion is 10 mm (M10) were used. The other portions of the spark plug (e.g. center electrode, insulator) were the same among the samples.

However, since a ground electrode does not affect the result of the test, the samples were tested without a ground electrode bonded to the metal housing.

A steel material including carbon in an amount of 0.2 percent by weight was used as a base material in Samples 1, 2, 4 to 6, while a steel material including carbon in an amount of 0.3 percent by weight was used as a base material in Sample 3. Each of the steel materials was forged and cut so as to produce a cut body, respectively. A metal hosing of Sample 1 was produced from the cut body without performing hardening steps (carburizing, quenching, and tempering). The metal housing of Sample 1 exhibited a Vickers hardness of 190 HV at a crimp portion and 200 HV at a thread rear-end portion. Metal housings of Samples 2 and 3 were produced from the cut bodies by performing a quenching and tempering process but without a carburizing process. The metal housing of Sample 2 exhibited a Vickers hardness of 190 HV at a crimp portion and 230 HV at a thread rear-end portion, while the metal housing of Sample 3 exhibited a Vickers hardness of 210 HV at a crimp portion and 390 HV at a thread rear-end portion. Metal housings of Samples 4 and 5 were produced from the cut bodies by performing a carburizing process but without a quenching and tempering process. The concentration of carbon atmosphere in the carburizing process was adjusted so that carbon content in a thread rear-end portion of the cut body of sample 4 became 0.5 percent by weight, while carbon content in a thread rear-end portion of the cut body of Sample 5 became 0.8 percent by weight. The thus produced metal housing of Sample 4 exhibited a Vickers hardness of 190 HV at the crimp portion and a Vickers hardness of 270 HV at the thread rear-end portion, while the metal housing of Sample 5 exhibited a Vickers hardness of 190 Hv at the crimp portion and a Vickers hardness of 330 HV at the thread rear-end portion. The cut body of Sample 6 was subjected to both of a carburizing process and a quenching and tempering process in this order. In the carburizing process, the concentration of carbon atmosphere was adjusted so that carbon content in a thread rear-end portion of the processed cut body of Sample 6 became 0.5 percent by weight. The thus produced metal housing of Sample 6 exhibited a Vickers hardness of 190 HV at the crimp portion and a Vickers hardness of 390 HV at the thread rear-end portion. The hardening processes and the resultant hardness of the portions of metal housings in each sample are shown in the following Table 1.

TABLE 1

| Sample No. | Carbon content in base material (wt %) | Partial hardening process: carburizing | Partial hardening process: quenching and tempering | Carbon content in processed base material (wt %) | Hardness at the crimp portion | Hardness at the thread rear-end portion |
|---|---|---|---|---|---|---|
| 1 | 0.2 | — | — | (0.2) | 190 | 190 |
| 2 | 0.2 | — | done | (0.2) | 190 | 230 |
| 3 | 0.3 | — | done | (0.3) | 210 | 390 |
| 4 | 0.2 | done | — | 0.5 | 190 | 270 |
| 5 | 0.2 | done | — | 0.8 | 190 | 330 |
| 6 | 0.2 | done | done | 0.5 | 190 | 390 |

A tolerance test for fastening torque of the thread rear end portions was conducted for Samples 1 to 6. In the tolerance test, an aluminum-made bushing having a female thread portion for mounting the samples, which is a mock-up of an engine head, was prepared and a seizure-preventing agent ('NEVER SEEZ' made by BOSTIK) was applied on the female thread portion. Then, a fastening torque which caused cracking or breaking at the thread rear-end portion (referred to as "breaking torque" hereinafter) was measured in each of the samples. The test results are shown in FIG. 6.

Figure 6:
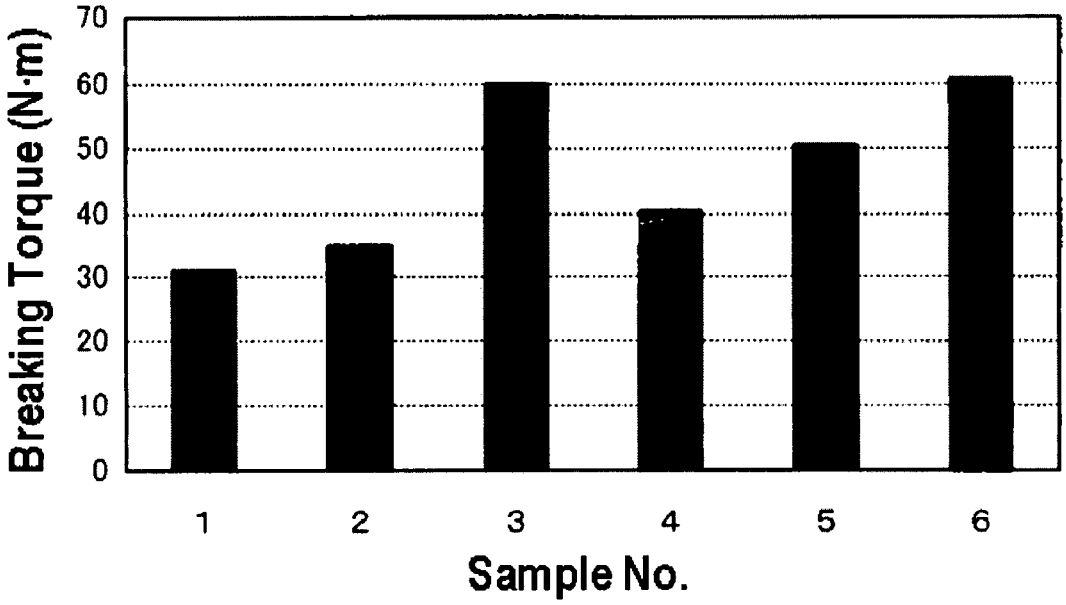
FIG. 6 is a graph showing breaking torque (N·m) as evaluated for each of Sample Nos. 1 to 6 of Example 1.

As shown in FIG. 6, compared with Sample 1 which was produced without any partial hardening process on the thread rear-end portion, the respective breaking torques in Samples 2 to 6 were enhanced. Thus, the at least one of quenching, tempering and carburizing carried out on a thread rear-end portion of a metal housing (i) effectively prevents cracking and breaking at a thread rear-end portion and a screw neck portion when a spark plug is fastened in a engine head, and (ii) increases tolerance against fastening torque of a spark plug.

Additionally, cross-sections of the thread rear-end portion and the crimp portion of Samples 1 to 6 were observed. A martensite phase was found in the cross-section of the thread rear-end portion of Samples 2, 3 and 6. On the other hand, a martensite phase was not observed in the cross section of the crimp portion, and instead, an austenite phase and/or pearlite phase was observed.

Example 2

A further evaluation test was conducted to analyze the difference between the hardness of the thread rear-end portion and the hardness of the crimp portion. In the evaluation test, as well as in Example 1, spark plugs of Samples 7 to 17 were produced using 11 types of metal housings, each of which had a different hardness between the crimp portion and the thread rear-end portion. The metal housings were produced using base steel materials having a different carbon content from one another, or by applying a partial hardening process different from one another. Hardness of the crimp portion and the thread rear-end portion of Samples 7 to 17 is shown in the following Table 2. Three spark plugs were produced per each sample and the hardness in the table shows the average of the three spark plugs.

TABLE 2

| Sample No. | Hardness of crimp portion (HV) | Hardness of thread rear-end portion (HV) | Difference in hardness (HV) | Evaluation |
|---|---|---|---|---|
| 7 | 200 | 410 | 210 | C |
| 8 | 140 | 380 | 240 | C |
| 9 | 160 | 390 | 230 | A |
| 10 | 160 | 210 | 50 | A |
| 11 | 180 | 380 | 200 | A |
| 12 | 200 | 300 | 100 | A |
| 13 | 220 | 350 | 130 | A |
| 14 | 240 | 300 | 60 | A |
| 15 | 260 | 310 | 50 | A |
| 16 | 280 | 380 | 100 | C |
| 17 | 260 | 290 | 30 | B |

Samples 7 to 17 were evaluated as to whether they fulfilled the standard or performance required of a commercial product. As the result, samples which did not exhibit any problems in light of the most strict standards for quality control of a spark plug were judged as good and ranked as 'A' or 'B' in Table 2, and the remaining samples were ranked as 'C'. The samples ranked as 'C' did not fulfill the most strict standards for quality control of a spark plug, but that does not always means that such 'C' ranked product is not useable.

In this evaluation test, firstly, the hardness of the crimp portion was evaluated. The crimp portions of Samples 7 to 17 had sufficient hardness to maintain plastic deformation after crimping. However, the Vickers hardness of the thread rear-end portion of Sample 8 was as low as 140 HV, which is not enough to secure air-tightness. Therefore, Sample 8, whose Vickers hardness at the crimp portion was less than 160 HV, was ranked as "C".

On the other hand, machinability of the crimp portion of each sample was evaluated. Each sample exhibited sufficient machinability for crimping. However, the Vickers hardness of the crimp portion of Sample 16 was as large as 280 HV, and at this level presents a higher risk of causing cracks during the crimping process and also of reducing the lifetime of crimping jigs. Thus, Sample 16, whose Vickers hardness at the crimp portion was 260 HV or higher, was ranked as "C".

Samples 7, 9 to 15 and 17, where the crimp portion had a Vickers hardness of from 160 HV to 260 HV, were accorded good evaluations in view of air-tightness at the crimp portion.

Next, the hardness of the thread rear-end portion was evaluated. Samples 7 to 17 had sufficient hardness to avoid cracking or breaking when fastened in an engine head. However, Sample 7, which had a higher hardness, had a higher risk of delayed fracture accompanying hydrogen embrittlement. Therefore, Sample 7 was ranked as "C". Samples 8-17, where the Vickers hardness at the thread rear-end portion was 390 HV or less, did not show any deficiency at the thread rear-end portion, and were evaluated as maintaining sufficient air-tightness in view of the performance of the thread rear-end portion.

As explained, Samples 9 to 15 were ranked "A", because no problem was found both at the crimp portion and at the thread rear end portion. Each of Samples 9 to 15 had a 50 HV or more difference in Vickers hardness between the crimp portion and the thread rear-end portion. On the other hand, Sample 17, which had only a 30 HV difference in Vickers hardness between the crimp portion and the thread rear-end portion, exhibited only a small effect of a partial hardening process compared with the cost for the process. Therefore, Sample 17 was ranked as "B". Additionally, Sample 10, where the Vickers hardness of the thread rear-end portion was 210, had a minimum air-tightness. However, in order to secure better air-tightness, a more preferable Vickers hardness of the thread rear-end portion is 250 HV or higher.

Needless to say, the present invention can be embodied in various other forms. For example, according to the present embodiment, the engaging portion 59 is simultaneously formed in the machining step (the groove-forming step in the machining step). However, the engaging portion 59 may be formed in a separate step after the thread 221 is formed through rolling.

The quenching process and the tempering process use a high-frequency heating apparatus. However, a laser or the like may be used for partial heating. Either the carburizing process or the quenching process and the tempering process may be omitted. After the spark plug 100 is assembled; i.e., after the insulator 10 is assembled with the metal housing 50, the partial hardening step for hardening the thread rear-end portion 150 may be performed.

According to the present embodiment, carburizing, quenching, and tempering are carried out for hardening the thread rear-end portion 150 and for obtaining internal toughness of the thread rear-end portion 150. However, the thread rear-end portion 150 may be hardened by forming a nitride on the surface thereof, or the thread rear-end portion 150 may be hardened by applying a hard plating onto the surface thereof. Alternatively, a hard thin-film or the like may be vapor-deposited on the surface of the thread rear-end portion 150 for hardening.

The talc 9 in the form of a powder was employed in the above embodiment; however, a talc ring, which is formed by compacting a talc powder into a tubular shape, may also be used.

Figure 7:
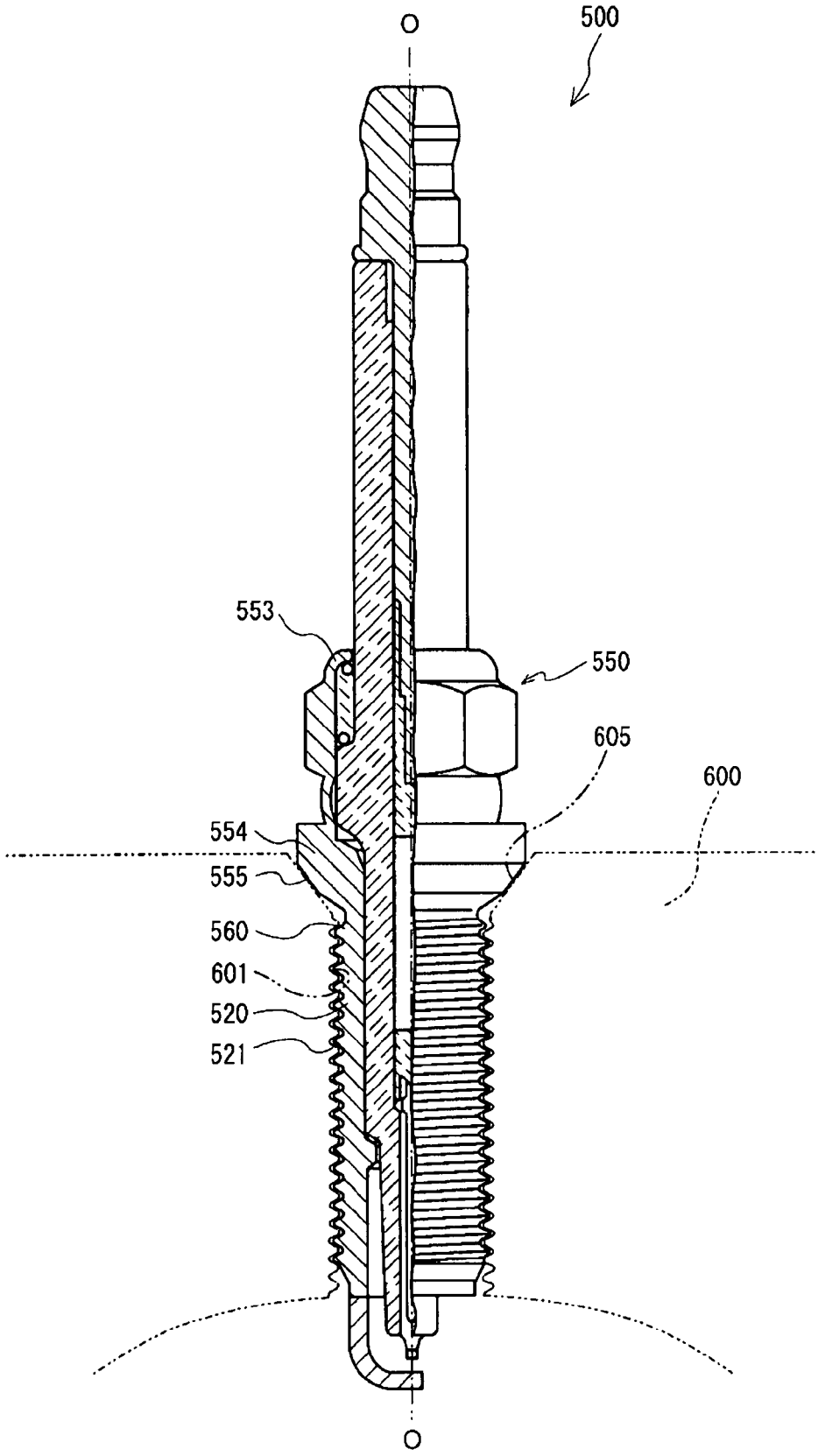
FIG. 7 is a partial sectional view of a spark plug 500.

Furthermore, although, according to the present embodiment, the gasket 5 is inserted in the groove-shaped engaging portion 59, which is formed at a screw neck portion of the metal housing 50, the seat surface 55 of the seal portion 54 can be altered to a tapered shape reducing its diameter toward the front side, like the seat surface 555 of spark plug 500 illustrated in FIG. 7. In this case, opening edge 605 of a mounting threaded hole 601 of an engine head 600 is formed in a tapered shape such that an abutting area of the seat surface 555 of the seal portion 554 of the metal housing 500 is enlarged. The spark plug 500 is fixed into the engine head so that the seat surface 555 of the seal portion 554 contacts the opening edge 605 of the engine head 600. As the result, gas leakage through the mounting threaded hole 601 can be prevented. In this structure, in order to enhance airtightness between the seat surface 555 of the seal portion 554 and the opening edge 605 of the engine head 600, threaded portion 520 of the metal housing 550 is fastened in the mounting threaded hole 601 of the engine head 600. Therefore, even in the spark plug 500, which does not include a gasket, it is effective to increase the hardness of the thread rear-end portion by means of a partial hardening process for the thread rear-end portion, (i.e., at least one of quenching, tempering and carburizing to improve the mechanical strength of the screw neck portion). A gasket can be applied to the spark plug 500 which was subjected to a partial hardening process.

The present invention can favorably yield its effects when applied to a spark plug whose diameter is desirably reduced. Particularly, the present invention can significantly yield its effects when applied to a spark plug whose mounting threaded portion has a nominal diameter of M10 or less or whose screw neck has a sectional area of 35 $mm^2$ or less.

It should further be apparent to those skilled in the art that various changes in form and detail of the invention as shown and described above may be made. It is intended that such changes be included within the spirit and scope of the claims appended hereto.

This application is based on Japanese Patent Application No. JP 2006-66911 filed Mar. 13, 2006, incorporated herein by reference in its entirety.

What is claimed is:

1. A spark plug comprising:

a center electrode;

an insulator having an axially extending axial hole and holding the center electrode in a front end portion of the axial hole, and a metal housing holding the insulator therein, wherein the metal housing comprises:

a threaded portion formed on an outer circumferential surface of a frontward portion of the metal housing; and a crimp portion formed at a rear end of the metal housing and crimping the insulator in the axial hole of the metal housing, wherein a rear-end portion of the threaded portion has a Vicker's hardness of from 250 HV to 400 HV that is higher than that of the entire crimp portion.

2. The spark plug as claimed in claim 1, wherein the difference in hardness between that of the rear-end portion of the threaded portion and the crimp portion is a Vickers hardness of 50 HV or more.

3. The spark plug as claimed in claim 1, wherein the crimp portion has a Vickers hardness of from 160 HV to 260 HV.

4. The spark plug as claimed in claim 1, wherein the rear-end portion of the threaded portion has a carbon content that is higher than that of the crimp portion.

5. The spark plug as claimed in claim 1, wherein the rear-end portion of the threaded portion includes carbon in a range of from 0.3 to 0.8 percent by weight.

6. The spark plug as claimed in claim 1, wherein the crimp portion includes carbon in a range of from 0.06 to 0.2 percent by weight.

7. The spark plug as claimed in claim 1, wherein the rear-end portion of the threaded portion includes a martensite phase.

8. The spark plug as claimed in claim 7, wherein the crimp portion of the metal housing substantially does not contain a martensite phase but includes at least one of an austenite phase and a pearlite phase.

9. The spark plug as claimed in claim 1, wherein the threaded portion has a nominal outside diameter of M10 or less.

10. A method of manufacturing a spark plug including a center electrode, an insulator having an axially extending axial hole and holding the center electrode in a front end portion of the axial hole, and a metal housing holding the insulator therein, the metal housing including a threaded portion formed on an outer circumferential surface of a frontward portion of the metal housing, and a crimp portion formed at a rear end of the metal housing and crimping the insulator in the axial hole of the metal housing, wherein a rear-end portion of the threaded portion has a Vicker's hardness of from 250 HV to 400 HV that is higher than that of the entire crimped portion, wherein the method comprises:

a thread-cutting step of forming a thread on a cylindrical member so as to form the threaded portion, the cylindrical member serving as a prototype of the metal housing and being formed by cold forging; and a partial hardening step of, after the thread-cutting step, subjecting a rear end portion of the threaded portion to a carburizing process or a quenching process so that the rear-end portion of the threaded portion assumes a hardness that is higher than that of the entire crimp portion.

11. The method of manufacturing a spark plug as claimed in claim 10, wherein said metal housing further comprises:

a seal portion located rearward of the threaded portion and projecting from an outer circumferential surface of the metal housing; and an engaging portion provided between the threaded portion and the seal portion for engaging an annular gasket therewith, the annular gasket sealing between the seal portion and a peripheral portion around an opening of a threaded hole in an internal combustion engine when the mounting threaded portion is screwed into the mounting threaded hole, wherein the method further comprises a groove-forming step of forming the engaging portion in the form of a groove along a circumferential direction for engaging the gasket therewith, the groove-forming step preceding the partial hardening step.

12. A spark plug comprising:

a center electrode;

an insulator having an axially extending axial hole and holding the center electrode in a front end portion of the axial hole, and a metal housing holding the insulator therein, wherein the metal housing comprises:

a threaded portion formed on an outer circumferential surface of a frontward portion of the metal housing; and a crimp portion formed at a rear end of the metal housing and crimping the insulator in the axial hole of the metal housing, wherein a rear-end portion of the threaded portion has a Vicker's hardness of from 250 HV to 400 HV that is higher than that of the crimp portion, and wherein the metal housing has a buckle portion at an axial position frontward of the crimped portion and to the rear of the threaded portion, the rear-end portion of the threaded portion having a hardness that is higher than that of the buckle portion.

* * * * *